US005149384A

United States Patent [19]

Marion

[11] Patent Number: 5,149,384

[45] Date of Patent: * Sep. 22, 1992

[54] PROPELLANT MATERIAL

[75] Inventor: Frank A. Marion, Glendale, Ariz.

[73] Assignee: Universal Propulsion Company, Inc., Phoenix, Ariz.

[ * ] Notice: The portion of the term of this patent subsequent to Oct. 28, 2003 has been disclaimed.

[21] Appl. No.: 489,288

[22] Filed: Mar. 5, 1990

Related U.S. Application Data

[63] Continuation of Ser. No. 78,569, Jul. 28, 1987, abandoned, which is a continuation of Ser. No. 750,228, Jun. 28, 1985, abandoned, which is a continuation of Ser. No. 547,854, Nov. 2, 1983, abandoned.

[51] Int. Cl.[5] ..... C06B 45/10

[52] U.S. Cl. ..... 149/19.1; 149/19.6; 149/19.9; 149/20; 149/45; 149/75; 149/108.2

[58] Field of Search ..... 149/19.1, 19.6, 19.9, 149/20, 45, 75, 108.2

[56] References Cited

U.S. PATENT DOCUMENTS

| | | | |
|---|---|---|---|
| 2,991,166 | 7/1961 | Ferguson | 149/19.9 |
| 3,046,168 | 7/1962 | Burkardt et al. | 149/87 |
| 3,418,184 | 12/1968 | Vetter | 149/19.9 |
| 3,910,805 | 10/1975 | Catanzarite | 149/75 |
| 3,945,202 | 3/1976 | Marion et al. | 149/19.9 |
| 4,128,443 | 12/1978 | Pawlak et al. | 149/86 |
| 4,619,722 | 10/1986 | Marion | 149/19.1 |

*Primary Examiner*—Edward A. Miller

*Attorney, Agent, or Firm*—Ellsworth R. Roston; Charles H. Schwartz

[57] ABSTRACT

A solid propellant acts in a chamber to propel a member such as a rocket, the chamber being closed to the atmosphere. The propellant provides high density-impulses and, when combusted, produces end products which do not have any deleterious effects. The propellant includes a binder/reducing agent having hydrocarbyl linkages including —$CH_2$— and a lead compound oxidizer formed from an inorganic lead oxidizer salt. The oxidizer has dense characteristics and stable properties at ambient temperatures and through a range of temperatures above ambient. A second oxidizer made from a metallic salt (not including lead) such as potassium perchlorate may also be included in the propellant. Carbon, preferably in particulate form, may also be included in the mixture as an additional reducing agent. The different materials are included in the propellant in relative amounts by weight to reduce the lead salt in the oxidizer to lead oxide. The oxidizing material may be included in the propellant in the range of approximately eighty four percent (84%) to ninety one percent (91%) by weight, the hydrocarbon in the range of approximately eight percent (8%) to ten percent (10%) by weight and the carbon in the range of approximately zero percent (0%) to eight percent (8%) by weight. The lead compound oxidizer is reduced in the propellant to lead oxide. The carbon may be oxidized in the propellant to carbon monoxide or carbon dioxide.

49 Claims, 2 Drawing Sheets

PROPELLANT MATERIAL

Figure 1:
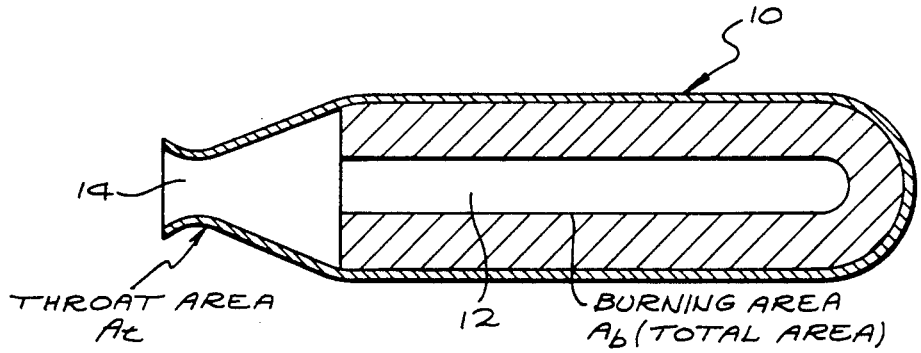

This is a continuation of application Ser. No. 078,569 filed Jul. 28, 1987, (now abandoned) which in turn is a continuation of application Ser. No. 750,288 filed Jun. 28, 1985 (now abandoned), which in turn is a continuation of application Ser. No. 547,854 filed Nov. 2, 1983 (now abandoned).

This invention relates to materials for providing an efficient propulsion of vehicles such as rockets. The invention further relates to materials having a high density and stable properties at ambient temperatures and providing considerable energy at elevated temperatures for producing an efficient propulsion of vehicles such as rockets. The invention is particularly concerned with propellants which combust to provide end products which are not deleterious to the propulsion chamber. The invention is also particularly concerned with propellants which combust at relatively low temperatures and still are quite stable.

For many rocket applications, the amount of propulsion energy capable of being stored in a limited volume of propulsion material is of prime importance. By increasing the amount of energy in each cubic inch of volume of such propulsion material, the volume of propulsion material required to store a particular amount of energy can be accordingly reduced. This in turn allows the rocket to be reduced in size and in weight, thereby causing the drag imposed on the rocket during the flight of the rocket through a fluid such as air or water to be correspondingly reduced. Since the drag imposed on the rocket is reduced, the amount of energy required to propel the rocket through a particular distance is reduced so that the amount of propulsion material required becomes correspondingly reduced. This in turn allows a further reduction in the size of the vehicle, with a corresponding reduction in drag. For the above reasons, a rocket required to push a heavy payload or move through a dense or viscous medium may have an increased efficiency if its propulsion material can be stored in a relatively small volume and can be provided with a high energy level.

The propulsion energy of a material is commonly measured in pound-seconds of force per pound of propellant (lb.sec./lb.). For example, if a propellant has a "specific impulse" of two hundred (200) lb.sec./lb., it can produce in a rocket motor two hundred (200) pounds of thrust (or force), per pound of weight of the propellant, for a duration of one (1) second. It can also produce any combination of thrust and time which, when multiplied, equals two hundred (200) lb.sec. per pound of propellant.

Various attempts have been made to increase the efficiency of propellants. For example, attempts have been made to increase the temperature of combustion of the different materials in the propellant. One broad line of effort has been to use, in the propellant, materials which have a low heat of formation or a low bond energy so that an increased amount of energy is available to be converted into heat. However, in order to have a low heat of formation, the materials generally must have a low margin of stability so that they are more dangerous to process, to store and to use than conventional materials.

Another approach toward increasing the specific impulse of the propulsion material has been to decrease the average molecular weight of the exhaust products.

For example, attempts have been made to combust highly energetic materials such as beryllium. However, these metals are quite toxic when vaporized and greatly increase the health hazards of anyone using such metals. Furthermore, any use of such metals in a combustible material would tend to add to contaminants in the atmosphere if the metals should become adopted on a widespread basis.

When materials such as magnesium, beryllium and titanium are used in the propulsion material, the density of the propulsion material tends to be reduced since magnesium, titanium and beryllium are relatively light. This has tended to be disadvantageous since the amount of energy obtained in combustion per cubic inch of volume becomes reduced. In other words, even though such metals as beryllium, titanium and magnesium have a high energy, the available energy per cubic inch of the propulsion material has not tended to be increased in view of the decreased density of the material. When metals such as beryllium have been used in the propulsion material, gases such as hydrogen have been added to the material, generally as a hydride of the metals. These hydrides tend to be somewhat unstable, requiring considerable care and special equipment for safe handling of them.

An extensive list of metallized solid propellants was published in 1966 by Reinhold Publishing Corp. in a book entitled, "Propellant Chemistry". This book was written by Stanley F. Sarner, Senior Research Chemist and Theoretical Analyst of Thiokol Chemical Corporation of Elkton, Md. This book lists values of specific impulse and density for approximately twenty (20) formulations of solid propellants which allegedly provide a high energy. The values of specific impulse for these formulations range upwardly to approximately 313.8 lb.sec.per pound of propellant formulation. The values of density are as high as approximately 0.0737 lb./inch$^3$. However, the maximum value of density impulse capable of being provided by any of these formulations is less than approximately 17.9 lb.sec./in$^3$. Furthermore, these formulations involve the use of toxic materials. Actually, practical and operable formulations heretofore available provide maximum values of density impulse of approximately fifteen (15) lb.sec./in$^3$. As g will be appreciated, values of density impulse/in$^3$ are important since they indicate the amount of energy available for propulsion per cubic inch of propulsion material.

U.S. Pat. No. 3,945,202 issued to me and Hugh J. McSpadden discloses a propellant which overcomes the disadvantages described above. The propulsion materials disclosed and claimed in U.S. Pat. No. 3,945,202 have a high density and provide a high value of specific impulse. They can be safely and easily formulated and are stable at ambient and elevated temperatures. They are not toxic in their formulation, storage or use. Furthermore, density-impulses as high as approximately twenty four (24) lb.sec. per pound of formulation have been obtained from the propulsion materials disclosed and claimed in this patent.

The propulsion materials disclosed and claimed in U.S. Pat. No. 3,945,202 include a binder, an oxidizer and a fuel additive. The binder preferably constitutes a hydrocarbon; the oxidizer preferably includes an inorganic lead oxidizer; and the g fuel additive preferably constitutes particles of a metal such as aluminum. The propellants combust in the combustion chamber to produce end products, one of which may be vaporized lead.

The production of vaporized lead in the combustion chamber is not advantageous. This results from the fact that lead vapor is an effective solvent for steel and for other metals. Lead vapor condenses at a temperature of approximately 1751° C., whereas iron melts at a temperature of approximately 1530° C. Since the combustion chamber will tend to be made from a material such as iron, the walls of the combustion chamber tend to become melted as the lead is vaporized during combustion. Furthermore, the heat of fusion of iron is approximately 3.67 kilocalories per mole and the heat of vaporization of lead is approximately 46.34 kilocalories per mole. As a result, for each mole of lead vapor condensate produced, 12.6 moles of iron can be melted.

Although lead vapor acts as a solvent on steel and other metals, lead oxide does not have such an effect. This results from the fact that lead oxide condenses at a temperature of approximately 1472° C., which is below the melting temperature of iron. Since lead oxide does not have any adverse effects on the walls of the combustion chamber, it is desirable that the end products of the combustion of inorganic lead oxidizer salts should be lead oxide rather than lead.

Copending U.S. Pat. No. 4,619,722 issued to me on Oct. 28, 1986 and assigned of record to the assignee of record of this application discloses and claims a propellant which preferably includes a binder and reducing agent having hydrocarbon inkages, an inorganic lead oxidizer salt and a fuel made from a fuel additive such as aluminum. The propellant combusts to produce as an end product lead oxide rather than lead. The propellant has a density-impulse which approximates, if not exceeds, the density-impulses of the propellants of U.S. Pat. No. 3,945,202 while providing significantly reduced temperatures during the combustion of the propellant.

The propellant disclose and claimed U.S. Pat. No. 4,619,722 preferably includes and a binder and reducing agent having hydrocarbon linkages and a lead compound oxidizer formed from an inorganic lead oxidizer salt. This oxidizer has dense characteristics and stable properties at ambient temperatures and through a particular range of temperatures above ambient. The propellant also includes a fuel additive, preferably a metal such as aluminum, having properties of being oxidized by the oxidizer and of reducing the lead. The fuel additive has a percentage by weight relative to the lead compound oxidizer to reduce the lead to lead oxide. The fuel additive is preferably included in the propellant in the range to approximately twenty percent (20%) by weight and is preferably in a fragmentary form. The binder preferably is included in the range of approximately eight percent (8%) to ten percent (10%) by weight. A second oxidizer such as potassium perchlorate may also be included in the propellant. The oxidizers are preferably included in the propellant in the range of approximately seventy-two percent (72%) to ninety-two percent (92%) by weight. An additional reducing agent such as carbon can also be included in the propellant.

In one embodiment of the invention, a solid propellant acts in a chamber to propel a member such as a rocket, the chamber being closed to the atmosphere. The propellant provides high density-impulses and, when combusted, produces end products which do not have any deleterious effects. The propellant includes a binder reducing agent having hydrocarbyl linkages including —$CH_2$—and a lead compound oxidizer formed from an inorganic lead oxidizer salt. The oxidizer has dense characteristics and stable properties at ambient temperatures and through a range of temperatures above ambient. A second oxidizer made from a metallic salt (not including lead) such as potassium perchlorate may also be included in the propellant. Carbon, preferably in particulate form, may also be included in the mixture as an additional reducing agent.

The different materials are included in the propellant in relative amounts by weight to reduce the lead salt in the oxidizer to lead oxide. The oxidizing materials may be included in the propellant in the range of approximately eighty four percent (84%) to ninety one percent (91%) by weight, the hydrocarbon in the range of approximately eight percent (8%) to ten percent (10%) by weight and the carbon in the range of approximately zero percent (0%) to eight percent (8%) by weight. The lead compound oxidizer is reduced in the propellant to lead oxide. The carbon may be oxidized in the propellant to carbon monoxide or carbon dioxide.

The propellant of this invention has certain distinct advantages over the propellants of the prior art. It provides high density-impulses and, when combusted, produces end products which do not have any deleterious effects. This results at least partly from the fact that the propellant produces lead oxide rather than lead when it combusts. The propellant is also advantageous in that it generates relatively low temperatures during combustion. For example, temperatures less than 1000° F. can be generated by at least some of the propellants of this invention. The invention accomplishes this by eliminating the fuel such as aluminum from the propellant. This is further advantageous in that it tends to simplify the formulation of the propellant.

By forming lead oxide and the other exhaust gases at relatively low temperatures during the combustion of the propellant, the formation of the propulsion chamber can be simplified. For example, the walls of the chamber can be made from a relatively standard material such as steel or copper and the heat insulation in the walls of the chamber can be minimized.

Figure 4:
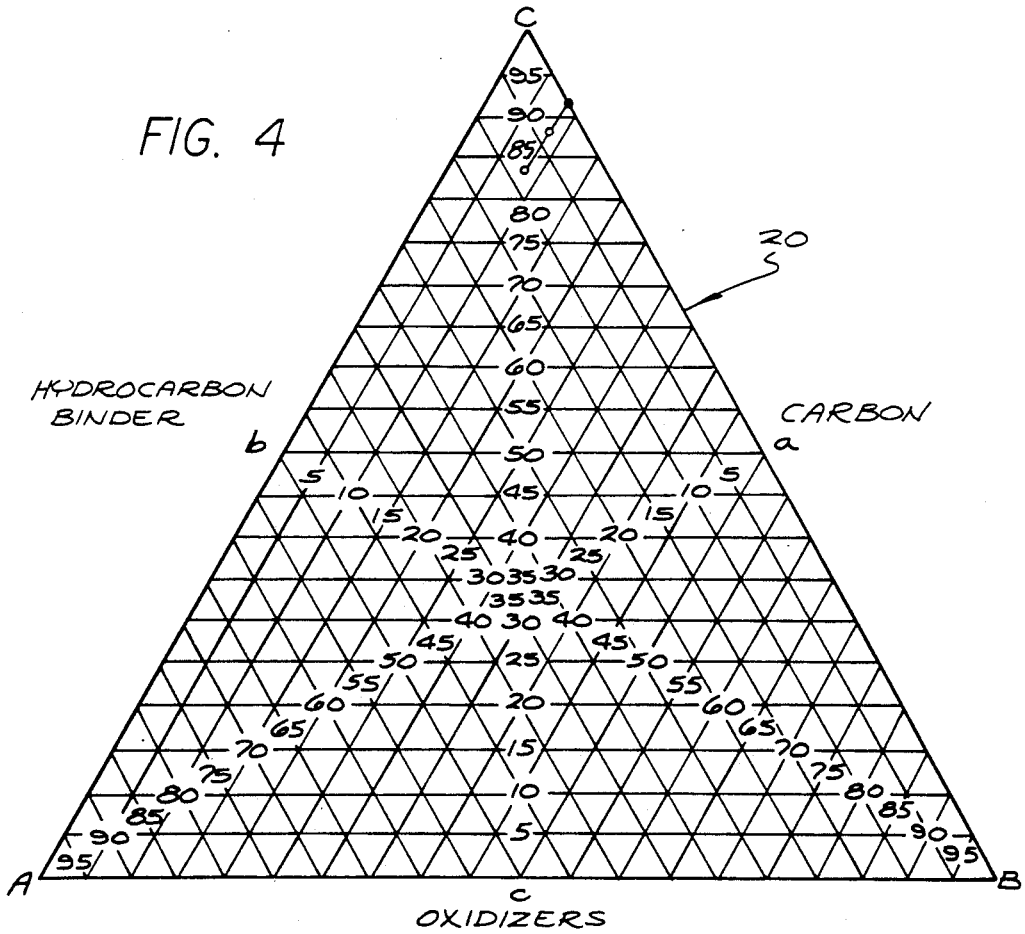
Figure 2:
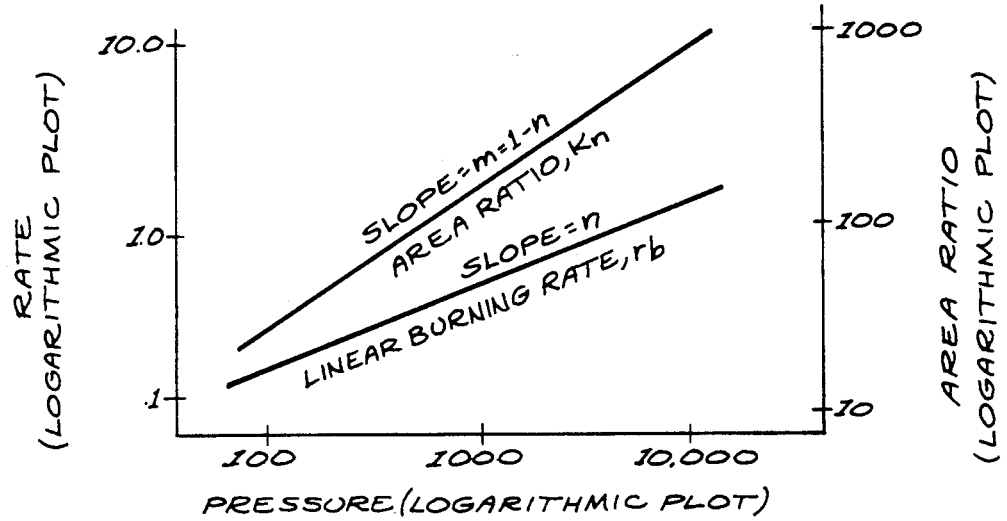
Figure 3:
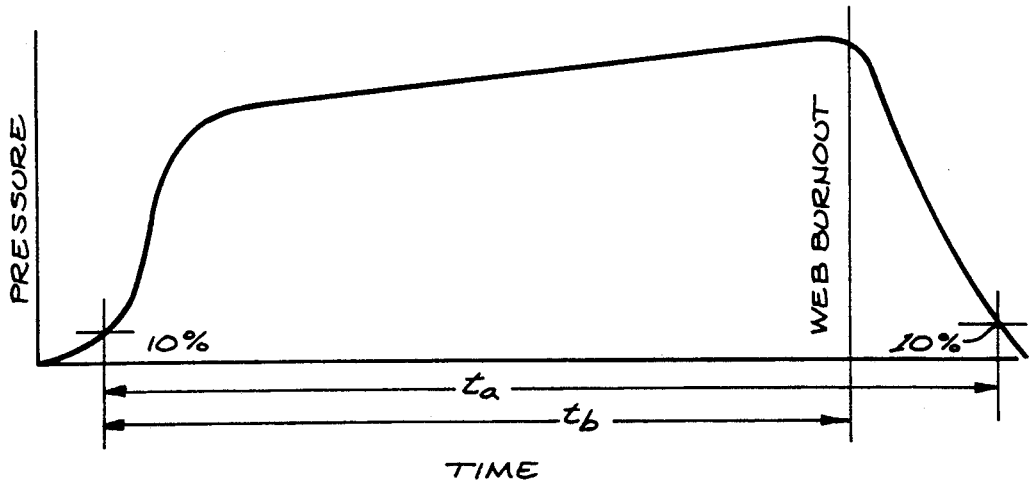

In the drawings:

FIG. 1 illustrates the configuration of a combustion chamber suitable for combusting the propellants of this invention;

FIG. 2 constitutes curves showing the relationship between the pressure of the exhaust gases from the propellant burning in the chamber of FIG. 1 and the rate at which the propellant burns;

FIG. 3 is a curve illustrating the relationship between time and pressure of the exhaust gases from the burning propellant; and g FIG. 4 is a curve in triangular coordination of the relative percentages of different chemical components in the propellant of this invention for different formulations of the propellant.

FIG. 1 schematically illustrates a chamber, generally shown at 10, for combusting the propellants of this invention. The walls of the chamber 10 may be made from a suitable material such as iron or steel or even copper, particularly when the exhaust gases resulting from the combustion of the propellant have a relatively low temperature such as a temperature less than approximately 1000° F. The components of the propellant combust in a burning area 12 and escape through a throat area 14. As will be seen, the propellant is isolated from the atmosphere so that the combustion occurs entirely from the components in the propellant.

FIG. 2 illustrates the relationship between the pressure of the gases escaping from the burning area 12 into the throat area 14 and the rate at which the propellant is combusted in the burning area 12. As will be seen, the relationship between rate and pressure is essentially linear with changes in pressure. FIG. 2 also indicates the relationship between the pressure of the gases escaping from the burning area 12 into the throat area 14 and the area ratio. As will be seen, this relationship is also essentially linear with changes in pressure FIG. 3 illustrates the pressure of the gases at progressive instants of time in the chamber illustrated in FIG. 1. As will be appreciated, the term $t_a$ represents the time between an initial pressure of ten percent (10%) of maximum pressure during the period of pressure build up and ten percent (10%) of maximum pressure during the period of pressure reduction.

The propellants of this invention preferably include a binder having hydrocarbon linkages. Preferably the binder includes a carbon hydride having a formula such as $CH_2$. The binder/reducing agent preferably is preferably in liquid form and has properties of being cured at a particular temperature. The binder may also be selected from a group including polysulfides, carboxy-terminated polybutadiene polymers, polytetra-fluoroethylene and acetal homopolymers (which do not cure but remain thermoplastic). These binders are advantageous since they retain good physical properties even in environments at high temperatures. For example, acetal homopolymers designated by the trademark or tradename "Delrin" melt at approximately 354° F. and polytetra-fluoroethylenes designated by the trademark or tradename "Teflon" melt at temperatures above 600° F. Certain of these binders such as the polysulfides Q and the carboxy-terminated polybutadiene polymers are castable and can be cured at ambient temperatures and also at oven temperatures with other materials to form the propellant formulations constituting the invention. The binder also acts as a reducing agent.

A number of propulsion materials have been formulated successfully with a mixture of a binder (and reducing agent) such as polybutadiene with carboxy-terminated linkages and a curing agent such as 1, 2, 4 Tris [2-(1-Aziridinyl)Ethyl] Trimellitate. The polybutadiene has been designated as "Butarez CTL Type II". Such a binder constitutes a liquid rubber polybutadiene with carboxy-terminated linkages. It has carboxy end-groups on both ends of the polymer chain, as illustrated as follows:

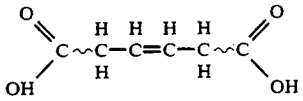

The binder (and reducing agent) has a relatively narrow molecular weight distribution and is not easily crystallized. This allows the cured composition of the polymer to remain rubbery to very low temperatures.

A lead compound oxidizer, such as an oxidizer formed from an inorganic lead oxidizer salt, is also included in the propellant. The oxidizer preferably constitutes lead nitrate. However, other lead oxidizers such as lead dioxide or lead iodate or any combination of the lead compounds specified above may also be used.

Lead nitrate has approximately 0.041 moles of oxygen per cubic centimeter. It has a specific gravity of approximately 4.53 grams per cubic centimeter. It has a decomposition temperature of approximately 470° C. and has a heat of formation of only approximately 107.35 Kilocalories per mole of oxygen. It can be reacted chemically to produce reasonably good enthalpy.

Lead vaporizes at a temperature of approximately 1751° C. Since tis temperature is considerably higher than the melting temperature of iron or steel, the lead melts the iron or steel when it vaporizes and contacts the iron or steel. Since the walls of the chamber 10 are generally made from iron or steel, the vapors from the propellant attack the iron or steel when the lead compound oxidizer becomes reduced to lead vapor. It is accordingly desirable to have the lead compound oxidizer become reduced to an end product other than lead. For example, lead oxide condenses at a temperature of approximately 1472° C., which is below the melting temperature of iron. As a result, lead oxide vapor does not act as a solvent on iron or steel.

Other materials may be used as secondary oxidizers in association with the inorganic lead compounds. These include strontium nitrate, barium nitrate, cesium nitrate, rubidium nitrate, ammonium perchlorate, potassium permanganate, potassium chlorate, potassium periodate, potassium nitrate, urea nitrate and guanidine nitrate. In addition to serving as oxidizers, these materials have the properties of altering the ballistic and physical properties of the rocket as desired. This secondary oxidizer preferably constitutes potassium perchlorate.

Various additives have been used to control the rate of propellant burning or to change the sensitivity of the burning rate to pressure. These additives have included copper manganite, cupric oxide, iron oxide and a liquid iron containing a burning rate catalyst designated by the trademark or tradename "HYCAT 6". The amount of additive used has varied between zero percent (0%) and five percent (5%) by weight of the propulsion formulation, but in certain formulations the amount of additive has been as high as approximately fifteen percent (15%). Other additives tested have included chromium oxide, manganese dioxide, cuprous oxide, n-butyl ferrocene, cupric acetylacetonate, molybdenal bis-acetylacetonate, titanium acetylacetonate, calcium oxalate and lead oxalate.

The different materials have been included as follows in the propellant of the prior art:

$$4CH_2+Pb(NO_3)_2+KClO_4+4Al \rightarrow 2Al_2O_3+4CO+KCl+4H_2+N_2+Pb \quad (1)$$

The inclusion of the different materials in the relative amounts of equation (1) offers a number of important advantages. For example, the formation of carbon monoxide is desirable because it provides approximately −105.6 Kilocalories (−25.4 Kilocalories per mole) of combustion enthalpy. This tends to provide a cooling effect on the combustion gases. Since the carbon is oxidized to carbon monoxide, the carbon cannot absorb heat. This is particularly important since carbon has a high heat capacity.

The propulsion formulation specified above also has other important advantages. For example, although the values of specific impulse for the propellants using the oxidizers specified above range from approximately 190 lb. sec/lb. to approximately 260 lb. sec/lb. and are accordingly within the range of previous propellants, the high density of the propellants using these oxidizers produces theoretical values of density-impulse from approximately 22 lb. sec./in$^3$ to approximately 27.6 lb. sec./in$^3$. Comparing such values with previously available values of approximately 15 lb. sec./in$^3$, this represents an increase of approximately sixty percent (60%) over the density-impulses of previously available propellants.

In spite of the advantages described above, there is one serious disadvantage from the reaction specified in equation (1). This results from the formation of vaporized lead. As previously described, the vaporized lead tends to melt the steel or iron walls of the combustion chamber, thereby limiting the effectiveness of the combustion chamber. The lead vapor is produced by the thermal decomposition of the lead nitrate in the material specified in equation (1).

The materials specified above can be varied in relative amounts to overcome the disadvantage specified in the previous paragraph without losing any of the advantages specified above. For example, the different materials can be included in the relative percentages specified below to provide a combustion which produces lead oxide, rather than lead, in the combustion gases:

$$4CH_2+Pb(NO_3)_2+KClO_4+3\tfrac{1}{2}\,Al\rightarrow 1\tfrac{2}{3}\,Al_2O_3+4CO+KCl+PbO+4H_2+N_2 \qquad (2)$$

The inclusion of the different materials in the percentages specified above in equation (2) offers certain distinct advantages. For example, the formation of lead oxide in the combustion gases inhibits any tendency for the walls of the combustion chamber to melt. This results from the fact that lead oxide vaporizes at a temperature below the melting temperature of steel or iron. The formulation as specified above in equation (2) is fully disclosed and claimed in application Ser. No. 530,956 filed by me on Sep. 12, 1983, and assigned of record to the assignee of record in this application.

The improved formulation of equation (2) also offers other important advantages. For example, the formulation of equation (2) provides a increased enthalpy over the formulation of equation (1) even though the amount of fuel in the formulation of equation (2) is significantly reduced relative to the amount in the formulation of equation (1). Specifically, the formulation of equation (2) produces an estimated combustion enthalpy of approximately −988 gram-calories/gram versus approximately −931 gram-calories/gram estimated for the formulation of equation (1).

The increased enthalpy for the formulation of equation (2) results in part from the formation of lead oxide. The heat of formation of lead oxide is approximately −52.1 Kilocalories per mole. This is in contrast to an endothermic heat of absorption of approximately 46.34 Kilocalories per mole for the formation of lead. This produces a resultant increase in combustion enthalpy of 52.1+46.34=98.44 Kilocalories per mole for the formulation of equation (2) relative to the formulation of equation (1).

As will be seen, there is a reduction of one third ($\frac{1}{3}$) of a mol of aluminum oxide in the propellant of equation (2) relative to the propellant of equation (1). This represents a reduction in enthalpy, particularly since the reduction of one third ($\frac{1}{3}$) of a mole in the amount of aluminum oxide formed represents a loss in enthalpy such as approximately −133 Kilocalories per mole. However, the net enthalpy per gram is increased by the relative increase in the amount of oxidizer and binder and constituting a reducing agent in the propellant of equation (2) relative to the propellant of equation (1). This relative increase results from the reduction of the weight and volume of aluminum in the propellant of equation (2) relative to the propellant of equation (1).

The elimination of lead vapor from the exhaust products of the propellant of equation (2) offers significant improvements in the design of the combustion chamber. This can be accomplished by reductions in the required insulating weight and volume of the combustion chamber, by reduction in the size of special seals and heat sinks and reduction in the heat transfer of vapor condensates at temperatures above the melting point of the material of the chamber walls. As a result, the propellant of equation (2) provides an aggregate improvement in product performance and reliability relative to the propellant of equation (1).

An additional improvement has resulted from a further reduction in the level of aluminum from that of equation (2). This further reduction in aluminum produces a reduction in combustion enthalpy and gas temperatures. This in turn enables the design of members such as rockets with increased burning time without encountering any serious material problems in the construction of rocket chambers and nozzles. The further reduction in the level of aluminum has caused a chemical reaction to be produced as follows:

$$4CH_2+Pb(NO_3)_2+KClO_4+2Al\rightarrow Al_2O_3+2CO_2+2CO+4H_2+KCl+N_2+PbO \qquad (3)$$

As will be seen, the propellant of equation (3) has the advantage of the propellent of equation (2) because lead oxide, rather than lead, is obtained as one of the combustion products. The decreased amount of the fuel such as aluminum causes the estimated enthalpy to be reduced to an estimated value such as approximately −826 gram-calories/gram from an estimated value of approximately −931 gram-calories/gram for the propellant of equation (1). This constitutes a reduction of approximately eleven and three tenths percent (11.3%) in enthalpy. However, the propellant of equation (3) has an increase of approximately ten percent (10%) in density relative to the propellant of equation (1). This increase is from a value of approximately 0.10 lb/cubic inch to a value of approximately 0.11 lb/cubic inch. This results in an estimated decrease of approximately only one percent (1%) in the density-impulse of the propellant of equation (3) relative to the propellant of equation (1).

The slight reduction in density-impulse in the formulation of equation (3) relative to the formulation of equation (1) is in contrast to the significant reduction in the temperatures of the combustion gases from the propellant of equation (3) relative to the propellant of equation (1). Corresponding reductions occur in the average molecular weight of the exhaust gases. This can in fact increase the specific impulse so as to produce an over all improvement in the density-impulse performance of the propellant formulation of equation (3) relative to the propellant formulation of equation (1).

As the level of aluminum is reduced from the formulation of equation (1) toward the formulation of equation (3), the volume displaced by the reduction in the amount of aluminum can be replaced by an equal volume of high density oxidizer or hydrocarbon binder or by a combination of the two (2). Aluminum has a lower density than the high density oxidizer such as lead nitrate (2.70 vs. 4.53). This causes an increased volume of lead nitrate equal to that in the reduction in the amount of aluminum to produce a sixty-eight percent (68%)

increase in specific gravity of lead nitrate relative to aluminum. In other words, replacing aluminum with lead nitrate causes the propellant density to be increased.

Aluminum reduces the burning rate of the propellant of equations (1), (2) and (3). Therefore, as the amount of aluminum in the propellant is reduced, the burning of the propellant is accelerated. This allows some of the potassium perchlorate to be removed from the propellant to maintain a particular burning rate. The potassium perchlorate removed from the propellant can be replaced in volume with a corresponding amount of lead nitrate. Potassium perchlorate has a specific gravity of approximately 2.5298 grams/cubic centimeter whereas lead nitrate has a specific gravity of approximately 4.53 grams/cubic centimeter. The replacement of the potassium perchlorate by lead nitrate accordingly produces an increase in specific gravity of approximately seventy-nine percent (79%) in a given volume.

As the aluminum content of the propellant is reduced below a critical ratio, the combustion enthalpy decreases more rapidly than the increase in density. This causes some reduction in density-impulse to occur. However, the reduction in the temperature of the exhaust gases from the combustion may facilitate design economy and simplicity within an acceptable level of density-impulse performance to warrant the use of such propellants with reduced amounts of aluminum.

As will be seen, all of the above propellants include a fuel such as aluminum. The propellants of this invention do not include the fuel such as aluminum. For example, one formulation of this invention may be as follows:

$$4CH_2 + 1\tfrac{1}{2}\,Pb(NO_3)_2 + KClO_4 \rightarrow 4CO_2 + 4H_2O + PbO + KCl + N_2 \quad (4)$$

This formulation represents a reduction in specific impulse of approximately twenty-two percent (22%) from the propellants which include aluminum. However, since aluminum has been eliminated the relative amount of the lead nitrate in the formulation is proportionately increased. This causes the formulation of equation (4) to be increased in density by approximately eleven percent (11%). This at least partially compensates for the decrease in the specific impulse of the formulation.

The formulation of equation (4) has a number of the advantages discussed above. For example, it produces lead oxide, rather than lead, as an end product during combustion. The formulation of equation (4) also has other advantages in addition to those discussed above. For example, it produces, during combustion, temperatures considerably lower than the conventional propellants of the prior art and the propellants of equations (1), (2) and (3). This enables the throat of the propulsion chamber to be made of a conventional material such as steel or copper. It also enables significant reductions to be provided in the volume and weight of the propulsion chamber. It also provides for significant reductions in the volume and weight of the insulation materials in the propulsion chamber, and particularly at the nozzle exit from the chamber.

The temperatures of the propellant exhaust gases can be further reduced by including carbon as a fuel (or a reducing agent) to obtain a propellant such as set forth below:

$$4CH_2 + 2C + Pb(NO_3)_2 + KClO_4 \rightarrow 3CO_2 + 3CO + PbO + 4H_2 + N_2 + KCl \quad (5)$$

This propellant has a high density and burns at a relatively low temperature. It can be considered as a high density "cool" gas generator. It provides an estimated heat of combustion of approximately −360 gram-calories/gram with an average density or specific gravity of approximately 0.099 pounds (lb)/(in$^3$).

All of the above equations have included an inorganic salt oxidizer such as potassium perchlorate. The combustion enthalpy can be further reduced by eliminating the potassium perchlorate from the propellant. This is also advantageous in increasing the specific gravity of the propellant since the relative amount of the lead nitrate in the propellant is increased. This causes the propellant to have a formulation such as specified below:

$$2.5CH_2 + 2.5C + Pb(NO_3)_2 \rightarrow 5CO + PbO + N_2 + 2.5H_2 \quad (6)$$

As will be seen, carbon monoxide is produced during the combustion of the propellant of equation (6). Partly because of the generation of carbon monoxide, the heat of combustion for the formulation of equation (6) is reduced to approximately −106 gram-calories/gram from the heat of combustion for the formulation of equation (5). As will be seen, this constitutes a significant reduction in the heat of combustion. Even with this considerable reduction in the heat of combustion, the density of the propellant of equation (6) is increased to a value of approximately 0.116 pound (lb)/inch$^3$ (in$^3$). Furthermore, the temperatures of the exhaust gases produced by the propellant of equation (6) tend to be below 1000° F. This is particularly pertinent since the formulation of equation (6) has a density almost twice as great as that of conventional gas generator propellants. The propellant also has a low burning rate. This is desirable for many designs of gas generators.

As the amount of carbon is reduced below that shown in equation (6), increased amounts of carbon dioxide, and reduced amount of carbon monoxide, are produced in the exhaust gases. The amount of combustion enthalpy tends to become increased at a relatively rapid rate as the amount of carbon is reduced. When the amount of carbon has been reduced to zero, the propellant may be as specified below:

$$2.5CH_2 + Pb(NO_3)_2 \rightarrow 2CO_2 + PbO + N_2 + 2.5H_2 \quad (7)$$

The combination enthalpy for the propellant of equation (7) may be expressed as $H_f = -94.05$ kilocalories/mol. As will be seen from equation (7), all of the oxygen in the propellant is used to generate carbon dioxide in the combustion, except for the one half (½) mole of oxygen used to generate lead oxide (PbO). This produces the maximum heat of combustion from the available oxygen.

A comparison of equations (6) and (7) indicates that two an one half (2½) moles of carbon monoxide are produced in the propellant of equation (6) in comparison to each mole of carbon dioxide produced by the propellant of equation (7). Thus, the addition of carbon to the propellant tends to be advantageous since it facilitates the use of oxygen in the formation of carbon monoxide. This produces an increase in the moles of exhaust gases produced in the combustion, a decrease in the average molecular weight of such exhaust gases and a reduction in the combustion enthalpy. It also tends to cool the exhaust gases.

The production of carbon monoxide in the exhaust gases also has other important advantages in the production of gas generators in addition to those discussed above. For example, carbon monoxide is chemically stable and is not chemically reactive. It also has a low oxidizing potential and a low heat of formation of approximately −26.4 kilocalories/mol. Because of this low heat formation, it would appear that oxygen can be easily removed from the carbon monoxide. However, the heat of formation of carbon vapor is approximately 17.17 kilocalories/ mol. Because of the considerable difference between the heat of formation of carbon monoxide and the heat of formation of carbon vapor, carbon monoxide is quite resistant to thermal disassociation.

The range of practical formulations of propellants including a hydrocarbon binder, oxidizers and carbon is shown in FIG. 4. As will be seen, the hydrocarbon binder has a range of approximately eight percent (8%) to ten percent (10%) by weight; the oxidizers have a range of approximately eighty four percent (84%) to ninety-one percent (91%) by weight; and the carbon has a range of approximately zero percent (0%) to eight percent (8%) by weight.

Typical formulations of the propellant are specified below:

Example 1:

| Material | Weight by Percentage |
|---|---|
| Hydrocarbyl Groups including $—CH_2—$ in the Reducing Agent | 9.6 |
| Lead Nitrate $(Pb(NO_3)_2$ | 90.4 |
| $CH_2 + Pb(NO_3)_2 \rightarrow PbO + 2.50CO_2 + 2.5H_2 + N_2$ | |

Example 2:

| Material | Weight |
|---|---|
| Hydrocarbyl Groups including $—CH_2—$ in the Reducing Agent | 10.7 |
| Lead Nitrate | 83.12 |
| Carbon | 6.1 |
| $3CH_2 + Pb(NO_3)_2 + 2C \rightarrow PbO + 5CO + 3H_2 + N_2$ | |

Example 3:

| Material | Weight by Percentage |
|---|---|
| Hydrocarbyl Groups including $—CH_2—$ in the Reducing Agent | 9.3 |
| Lead nitrate $(Pb(NO_3)_2$ | 87.5 |
| Carbon (C) | 3.2 |
| $2.5CH_2 + Pb(NO_3)_2 + C \rightarrow PbO + 1.5CO_2 + 2CO + 2.5H_2 + N_2$ | |

Example 4:

| Material | Weight by Percentage |
|---|---|
| Hydrocarbyl Groups including $—CH_2—$ in the Reducing Agent | 7.1 |
| Lead nitrate $(Pb(NO_3)_2$ | 83.8 |
| Carbon (C) | 9.1 |
| $2CH_2 + 3C + Pb(NO_3)_2 \rightarrow PbO + 5CO + 2H_2 + N_2$ | |

Example 5:

| Material | Weight by Percentage |
|---|---|
| Hydrocarbyl Groups including $—CH_2—$ in the Reducing Agent | 8.8 |
| Lead nitrate | 83.6 |
| Carbon | 7.6 |
| $2.5CH_2 + 2.5C + Pb(NO_3)_2 \rightarrow PbO + 5CO + 2.5H_2 + N_2$ | |

The different formulations specified above in Examples 1 through 5 are plotted in the curve illustrated at 20 in FIG. 4. Specific formulas can be developed at any point selected along the curve illustrated in FIG. 4. Specific performance criteria such as burning rate, specific impulse and density impulse can be formulated by extrapolating from established data points or by interpolating between established data points. It will be appreciated, however, that the invention is not to be limited to the formulations along the curve of FIG. 4 or the extrapolations or interpolations along the points of such curve.

The propellants disclosed above as being included in this invention have certain important advantages. They produce lead oxide, rather than lead, in the exhaust gases. This allows the walls of the combustion chamber to be made from conventional materials such as iron or steel without damaging such walls during the combustion. The propellants produce the exhaust gases at relatively low temperatures during the combustion. For example, some of the propellants of this invention even produce exhaust gases with temperatures below 1000° F. during the combustion. This allows the walls of the chamber to be made from such materials as copper and it further allows the amount of insulation in the chamber to be minimized. The propellants of this invention also produce, during the combustion, a relatively high energy per cubic inch of the propellant.

Although this invention has been disclosed and illustrated with reference to particular embodiments, the principles involved are susceptible for use in numerous other embodiments which will be apparent to persons skilled in the art. The invention is, therefore, to be limited only as indicated by the scope of the appended claims.

I claim:

1. A propellant, consisting of:

a binder/reducing agent having hydrocarbyl linkages including $—CH_2—$, a first oxidizing material formed from an inorganic lead oxidizer salt, and a second oxidizing material containing oxygen and at least one element other than lead, the first and second oxidizing materials and the binder/reducing agent being provided in relative percentages by weight, and being combustible at temperatures below the temperature of vaporized lead, to obtain a reduction of the first oxidizing material substantially only to lead oxide, (Pbo), and not lead, during the combustion of the propellant at temperatures below the temperature of vaporized lead.

2. A propellant, consisting of:

a binder/reducing agent having hydrocarbyl linkages including $—CH_2—$, a first oxidizing material formed from an inorganic lead oxidizer salt, a second oxidizing material containing oxygen and at least one element other than lead, the first and second oxidizing materials and the binder/reducing agent being provided in relative percentages by weight, and being combustible at temperatures below the temperature of vaporized lead, to obtain a reduction of the first oxidizing material substantially only to lead oxide, (Pbo), and not lead, during the combustion of the propellant at temperatures below the temperature of vaporized lead, and carbon as an additional reducing agent.

3. The propellant set forth in claim 1, wherein the total amount of the first and second oxidizing materials is approximately eighty-four percent (84%) to ninety-one percent (91%) by weight.

4. The propellant set forth in claim 1 wherein the total amount of the binder/reducing agent is approximately eight percent (8%) to ten percent (10%) by weight.

5. The propellant set forth in claim 2 wherein the total amount of the first and second oxidizing materials is approximately 84%-91% by weight and the total amount of the binder/reducing agent is approximately eight percent (8%) to ten percent (10%) by weight and the total amount of the additional reducing agent is approximately zero percent (0%) to eight percent (8%) by weight.

6. The propellant set forth in claim 1 wherein the first oxidizing material is selected from the group consisting of lead nitrate, lead peroxide and lead iodate.

7. The propellant set forth in claim 6 wherein the second oxidizing material is selected from the group consisting of strontium nitrate, barium nitrate, cerium nitrate, rubidium nitrate, ammonium perchlorate, potassium periodate, potassium nitrate, urea nitrate and guanidine nitrate, and the first and second oxidizing agent and the binder/reducing agent are provided in relative percentages in the propellant to obtain the production of at least one of carbon monoxide and carbon dioxide during the combustion of the propellant.

8. The combination set forth in claim 1 wherein the first oxidizing material is lead nitrate and the second oxidizing material is potassium perchlorate.

9. A propellant consisting of,
lead nitrate as an oxidizer,
potassium perchlorate as an oxidizer,
a binder/reducing agent having hydrocarbyl linkages including $—CH_2—$,
the relative amounts of the lead nitrate, the potassium perchlorate and the binder/reducing agent being selected to obtain the combustion of such materials at temperatures below the temperature of vaporized lead and the reduction of the lead nitrate substantially only to lead oxide (Pbo), and not lead, during the combustion of the propellant at the temperatures below the temperature of vaporized lead.

10. The propellant set forth in claim 9 wherein the lead nitrate, the potassium perchlorate and the binder/reducing agent are provided with relative proportions to produce combustion temperatures less than 1000° F.

11. The propellant set forth in claim 9 wherein the lead nitrate and the potassium perchlorate have a relative percentage by weight from approximately eighty-four percent (84%) to ninety-one percent (91%) by weight.

12. The propellant set forth in claim 9 wherein the total amount of the binder/reducing agent is approximately eight percent (8%) to ten percent (10%) by weight.

13. A propellant consisting of,
lead nitrate as an oxidizer,
a binder/reducing agent having hydrocarbyl linkages including $—CH_2—$,
the relative amounts of the lead nitrate and the binder/reducing agent being selected to obtain the combustion of such materials at temperatures below the temperature of vaporized lead and the reduction of the lead nitrate substantially only to lead oxide (Pbo), and not lead, during the combustion of the propellant at the temperatures below the temperature of vaporized lead, and
carbon as an additional reducing agent.

14. The propellant set forth in claim 13 wherein the total amount of the carbon constituting the additional reducing agent is in a range to approximately eight percent (8%) by weight.

15. A propellant consisting of,
a binder/reducing agent having hydrocarbyl linkages including $—CH_2—$,
a lead compound oxidizer formed from inorganic lead oxidizer salts and having dense characteristics and stable properties at ambient temperatures and through a particular range of temperatures above ambient temperatures, and
a second oxidizer containing oxygen and an element other than lead,
the binder/reducing agent, the lead compound oxidizer and the second oxidizer being provided with relative percentages by weight, and being combustible at temperatures below the temperature of vaporized lead, to reduce the lead compound oxidizer substantially only to lead oxide (Pbo), and not lead, during the combustion of the propellant at the temperature below the temperature of vaporized lead.

16. The propellant set forth in claim 15 wherein the second oxidizer is an inorganic salt.

17. The propellant set forth in claim 16 wherein the total amount of the binder/reducing agent is approximately eight percent (8%) to ten percent (10%) by weight.

18. The propellant set forth in claim 16 wherein the lead compound oxidizer is selected from the group consisting of lead nitrate, lead peroxide and lead iodate.

19. A propellant consisting of,
a binder/reducing agent having hydrocarbyl linkages including $—CH_2—$,
a lead compound oxidizer formed from inorganic lead oxidizer salts and having dense characteristics and stable properties at ambient temperatures and through a particular range of temperatures above ambient temperatures, and
a second oxidizer containing oxygen and an element other than lead,
the binder/reducing agent, the lead compound oxidizer and the second oxidizer being provided with relative percentages by weight, and being combustible at temperatures below the temperature of vaporized lead, to reduce the lead compound oxidizer substantially only to lead oxide (Pbo), and not lead, during the combustion of the propellant at the temperatures below the temperature of vaporized lead,
the second oxidizer being an inorganic salt,
the lead compound oxidizer being selected from the group consisting of lead nitrate, lead peroxide and lead iodate, and
carbon being included as an additional reducing agent.

20. A propellant, consisting of a binder/reducing agent having hydrocarbyl linkages including —$CH_2$—, and a lead compound oxidizer formed from an inorganic lead oxidizer salt and having dense characteristics and stable properties at ambient temperatures and through a particular range of temperatures above ambient temperatures, the binder/reducing agent and the lead compound oxidizer having relative percentages by weight in the combination, and being combustible at temperatures below the temperature of vaporized lead, to reduce the lad compound oxidizer substantially only to lead oxide (Pbo), and not lead, during the combustion of the propellant at the temperatures below the temperatures of vaporized lead.

21. The propellant set forth in claim 20 including the total amount of the lead compound oxidizer being approximately eighty-three percent (83%) to ninety-one percent (91%) by weight.

22. A propellant, consisting of a binder/reducing agent having hydrocarbyl linkages including —$CH_2$—, and a lead compound oxidizer formed from an inorganic lead oxidizer salt and having sense characteristics and stable properties at ambient temperatures and through a particular range of temperatures above ambient temperatures, the binder/reducing agent and the lead compound oxidizer having relative percentages by weight in the combination, and being combustible at temperatures below the temperature of vaporized lead, to reduce the lead compound oxidizer substantially only to lead oxide (Pbo), and not lead, during the combustion of the propellant at the temperatures below the temperatures of vaporized lead, and carbon as an additional reducing agent.

23. The propellant set forth in claim 20 wherein the inorganic lead oxidizer salt is selected from the group consisting of lead nitrate, lead peroxide and lead iodate.

24. The propellant set forth in claim 22 wherein the total amount of the carbon constituting the additional reducing agent is in a range to approximately ten percent (10%) by weight.

25. The propellant set forth in claim 24 wherein the total amount of the binder/reducing agent is in the range of approximately eight percent (8%) to ten percent (10%) by weight.

26. The propellant set forth in claim 24 wherein the lead compound oxidizer is lead nitrate.

27. A propellant, consisting of a binder/reducing agent having hydrocarbyl linkages including —$CH_2$—, and lead nitrate, the binder/reducing agent and the lead nitrate having relative proportions by weight, and being combustible at temperatures below the temperature of vaporized led, to reduce the lad nitrate substantially only to lead oxide (Pbo), and not lead, during the combustion of the propellant at the temperature below the temperature of vaporized lead.

28. A propellant, consisting of a binder/reducing agent having hydrocarbyl linkages including —$CH_2$—, and lead nitrate, the binder/reducing agent and the lead nitrate having relative proportions by weight, and being combustible at temperatures below the temperature of vaporized lead, to reduce the lead nitrate substantially only to lead oxide (Pbo), and not lead, during the combustion of the propellant at the temperature below the temperature of vaporized lead, and carbon as an additional reducing agent.

29. The propellant set forth in claim 28 wherein the total amount of the lead nitrate is in a range of approximately eighty-four percent (84%) to ninety-one percent (91%) by weight, the total amount of the binder/reducing agent is in a range of approximately eight percent (8%) to ten percent (10%) by weight and the total amount of the carbon constituting the additional reducing agent is in a range to approximately ten percent (10%) by weight.

30. The propellant set forth in claim 27 wherein the binder/reducing agent and the lad nitrate have relative proportions by weight to produce at least one of carbon monoxide nd carbon dioxide during the combustion of the propellant.

31. The propellant set forth in claim 1 wherein the first and second oxidizing materials and the reducing agent are provided in relative percentages by weight to obtain the production of at least one of carbon monoxide and carbon dioxide during the combustion of the propellant.

32. The propellant set forth in claim 9 wherein the lead nitrate, the potassium perchlorate and the binder/reducing agent are provided in relative percentages by weight to obtain the production of at least one of carbon monoxide and carbon dioxide during the combustion of the propellant.

33. The propellant set forth in claim 15 wherein the binder/reducing agent, the lead compound oxidizer and the second oxidizer are provided in relative percentages by weight to obtain the production of at least one of carbon monoxide and carbon dioxide during the combustion of the propellant.

34. The propellant set forth in claim 20 wherein the binder/reducing agent and the lead compound oxidizer are provided in relative percentages by weight to obtain the production of at least one of carbon monoxide and carbon dioxide during the combustion of the propellant.

35. A propellant, consisting of a binder/reducing agent having hydrocarbyl linkages including —$CH_2$—, and a compound formed from an inorganic lead oxidizer salt and serving as an oxidizing agent, the binder/reducing agent and the compound formed from the inorganic lead oxidizer salt having relative proportions by weight, and being combustible at temperatures below the temperature of vaporized lead, to reduce the compound formed from the inorganic lead oxidizer salt substantially only to lead oxide (Pbo), and not lead, during the combustion of the propellant at the temperatures below the temperature of vaporized lead.

36. A propellant as set forth in claim 35 wherein the total amount of the binder/reducing agent by moles is approximately two and one-half (2½) times greater than the relative amount of the lead-oxygen compound by moles.

37. A propellant, consisting of a binder/reducing agent having hydrocarbyl linkages including —$CH_2$—, and a compound formed from an inorganic lead oxidizer salt and serving as an oxidizing agent, the binder/reducing agent and the compound formed from the inorganic lead oxidizer salt having relative proportions by weight, and being combustible at temperatures below the temperature of vaporized lead, to reduce the compound formed from the inorganic lead oxidizer salt substantially only to lead oxide (Pbo), and not lead, during the combustion of the propellant at the temperatures below the temperature of vaporized lead, and carbon included as an additional reducing agent.

38. A propellant, consisting of a binder/reducing agent having hydrocarbyl linkages including —$CH_2$—, and a compound formed from an inorganic lead oxidizer salt and serving as an oxidizing agent, the binder/reducing agent and the compound formed from the inorganic lead oxidizer salt having relative proportions by weight and being combustible at temperatures below the temperature of vaporized lead to reduce the inorganic lead oxidizer salt substantially only to lead oxide (Pbo), and not lead, during the combustion of the propellant at the temperatures below the temperature of vaporized lead, the relative amount of the binder/reducing agent by moles being approximately two and one-half ($2\frac{1}{2}$) times greater than the relative amount of the lead-oxygen compound by moles, and carbon as an additional reducing agent in substantially the same relative amount as the binder/reducing agent by moles.

39. A propellant as set forth in claim 35 wherein the lead-oxygen compound is lead nitrate.

40. A propellant as set forth in claim 38 wherein the oxidizing agent is lead nitrate.

41. A propellant, consisting of a binder/reducing agent having hydrocarbyl linkages including —$CH_2$—, a compound formed from an inorganic lead oxidizer salt and serving as an oxidizing agent, the binder/reducing agent and the compound formed from the inorganic lead oxidizer salt having relative proportions by weight, and being combustible at temperatures below the temperature of vaporized lead, to reduce the lad-oxygen compound substantially only to lead oxide (Pbo), and not lead, during the combustion of the propellant at the temperatures below the temperature of vaporized lead, and and an additional oxidizer containing oxygen and a particular element other than lead.

42. A propellant, consisting of a binder/reducing agent having hydrocarbyl linkages including —$CH_2$—, a compound formed from an inorganic lead oxidizer salt and serving as an oxidizing agent, the binder/reducing agent and the compound formed from the inorganic lead oxidizer salt having relative proportions by weight, and being combustible at temperatures below the temperature of vaporized lead, to reduce the lead-oxygen compound substantially only to lead oxide (Pbo), and not lead, during the combustion of the propellant at the temperatures below the temperature of vaporized lead, an additional oxidizer containing oxygen and a particular element other than lead, and carbon as an additional reducing agent.

43. A propellant as set forth in claim 1 wherein the binder/reducing agent is in liquid form.

44. A propellant as set forth in claim 2 wherein the binder/reducing agent is in liquid form.

45. A propellant as set forth in claim 19 wherein the binder/reducing agent is in liquid form.

46. A propellant as set forth in claim 20 wherein the binder/reducing agent is in liquid form.

47. A propellant as set forth in claim 22 wherein the binder/reducing agent is in liquid form.

48. A propellant as set forth in claim 35 wherein the binder/reducing agent is in liquid form.

49. A propellant as set forth in claim 37 wherein the binder/reducing agent is in liquid form.

* * * * *